US007101213B2

(12) United States Patent
Toyoda

(10) Patent No.: US 7,101,213 B2
(45) Date of Patent: Sep. 5, 2006

(54) CONNECTOR

(75) Inventor: Yukihiro Toyoda, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/272,126

(22) Filed: Nov. 10, 2005

(65) Prior Publication Data

US 2006/0105611 A1 May 18, 2006

(30) Foreign Application Priority Data

Nov. 12, 2004 (JP) ..... 2004-328959

(51) Int. Cl.
*H01R 13/627* (2006.01)

(52) U.S. Cl. ..... 439/358

(58) Field of Classification Search ..... 439/350, 439/353, 354, 357, 358
See application file for complete search history.

(56) References Cited

U.S. PATENT DOCUMENTS

| | | | | |
|---|---|---|---|---|
| 4,273,403 | A * | 6/1981 | Cairns | 439/345 |
| 4,925,398 | A * | 5/1990 | Samejima et al. | 439/357 |
| 5,336,101 | A | 8/1994 | Kasugai et al. | |
| 5,378,168 | A * | 1/1995 | Sumida | 439/358 |
| 5,409,395 | A * | 4/1995 | Okada | 439/354 |
| 5,820,400 | A * | 10/1998 | Yamanashi et al. | 439/358 |
| 5,827,086 | A * | 10/1998 | Fukuda | 439/357 |
| 5,938,470 | A * | 8/1999 | Kashiyama | 439/489 |
| 6,007,362 | A * | 12/1999 | Davis et al. | 439/358 |
| 6,086,411 | A * | 7/2000 | Shinozaki | 439/489 |
| 6,146,183 | A | 11/2000 | Jinno et al. | |
| 6,217,365 | B1 * | 4/2001 | Shinozaki | 439/358 |
| 6,343,948 | B1 * | 2/2002 | Nutzel | 439/358 |
| 6,435,896 | B1 * | 8/2002 | Takatsuki | 439/354 |
| 6,561,834 | B1 * | 5/2003 | Chen | 439/358 |
| 6,579,113 | B1 * | 6/2003 | Kodama | 439/358 |
| 6,669,398 | B1 | 12/2003 | Wada et al. | |
| 6,688,907 | B1 * | 2/2004 | Yamaoka et al. | 439/489 |
| 2001/0021603 | A1 * | 9/2001 | Chen | 439/358 |
| 2001/0049220 | A1 * | 12/2001 | Kodama | 439/357 |
| 2002/0119693 | A1 * | 8/2002 | Chen | 439/358 |
| 2003/0228788 | A1 * | 12/2003 | Igarashi et al. | 439/358 |
| 2004/0005805 | A1 * | 1/2004 | Shibata | 439/358 |
| 2004/0067676 | A1 | 4/2004 | Nimura | |

FOREIGN PATENT DOCUMENTS

DE 299 21 254 4/2001

* cited by examiner

*Primary Examiner*—Ross Gushi
(74) *Attorney, Agent, or Firm*—Gerald E. Hespos; Anthony J. Casella

(57) ABSTRACT

A lock arm (12) on a female housing (1) is deformed at an intermediate stage of connecting the female housing (1) with a mating male housing (20). A lock (13) at the leading end of the lock arm (12) contacts an edge (23D) of an engaging portion (23) on the male housing (20) and then parts therefrom by canceling a rubbing state. The lock arm (12) then restores resiliently and the lock (13) engages the engaging portion (23) to lock the housings (1, 20) in a properly connected state. At least one of the lock (13) and the edge (23D) of the engaging portion (23) that rub against each other immediately before the proper connection of the two housings (1, 20) has a resistance alleviating portion (13C) with an apex locally projecting toward the other rubbed part.

15 Claims, 6 Drawing Sheets

CONNECTOR

BACKGROUND OF THE INVENTION

1. Field of the Invention

The invention relates to a connector.

2. Description of the Related Art

U.S. Pat. No. 5,336,101 discloses a connector assembly with male and female housings that can be connected together. A lock arm is provided on an upper surface of the female housing and a lock is formed on the leading end of the lock arm. The lock arm can pivot about the base end so that the lock at the leading end of the lock arm displaces. An engaging projection is provided on the upper surface of the male housing. The lock moves onto the engaging projection during the connection of the male and female housings. The lock then contacts the rear edge of engaging projection and parts from the rear edge that have been rubbed against. The lock arm then returns resiliently while following a pivoting path. In this way, the lock engages the engaging projection to lock the male and female housings in their connected state.

The rear edge of the leading end of the above-described lock and the rear edge of the engaging projection are in line contact with each other along the width direction when they part from each other in the connecting process. Thus, the rear edge of the leading end of the above-described lock and the rear edge of the engaging projection cannot part smoothly from each other due to contact resistance therebetween. Accordingly, a connection feeling upon connecting or separating the two housings deteriorates.

The invention was developed in view of the above problem and an object thereof is to improve connection feeling and separation feeling upon connecting and separating two connectors.

SUMMARY OF THE INVENTION

The invention relates to a connector with first and second housings that are connectable with each other. A resiliently deformable lock arm is provided on the first housing and includes a lock. An engaging portion is provided on the second housing. The lock arm deforms resiliently at least at an intermediate stage of a connecting operation of the two housings. The lock contacts an edge of the engaging portion immediately before proper connection of the two housings. As a result, the lock arm is restored resiliently so that the lock engages the engaging portion to lock the two housings in a properly locked state. At least one of the lock and the edge of the engaging portion that rub together immediately before the proper connection of the housings has a resistance alleviating portion with an apex that projects locally towards the mating rubbed part.

The lock preferably is at the leading end of the lock arm.

The lock preferably parts from the edge by canceling a rubbed state against the edge at or after the proper connection of the two housings. Thus the lock arm is restored resiliently.

The resistance alleviating portion achieves point contact when the lock contacts the edge of the engaging portion in the process of connecting the two housings. As a result, contact resistance is reduced and the lock arm hits the mating housing with a force that makes a loud hitting or clicking sound with an audible and tactile indication of connection. Therefore, connection feeling is improved. Similarly, the lock and the edge of the engaging portion are in point contact when the lock contacts the edge during the separation the two housings. Thus, separation feeling is improved and the separating operation is completed without a dragging feeling.

The lock arm preferably is cantilevered forward, and the lock is at or near the leading end of the lock arm. The engaging portion preferably is a projection on an outer surface of the other housing.

The resistance alleviating portion preferably is a cone or a polygonal pyramid at a part of the lock to be rubbed against the rear edge of the engaging portion and has an apex oriented substantially towards an engaging side.

An unlocking lever preferably is provided separately from the lock arm. The unlocking lever does not deform during connection of the two housings. However, an operable portion can be operated to deform the unlocking lever, and deformation of the unlocking lever deforms the lock arm in an unlocking direction so that the housings can be separated.

Protection walls preferably are formed at the sides of the engaging portion and preferably extend in forward and backward directions over substantially the entire length.

At least one guiding wall may slide in contact with surfaces of the protection walls for guiding the connection.

These and other objects, features and advantages of the present invention will become more apparent upon reading of the following detailed description of-preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
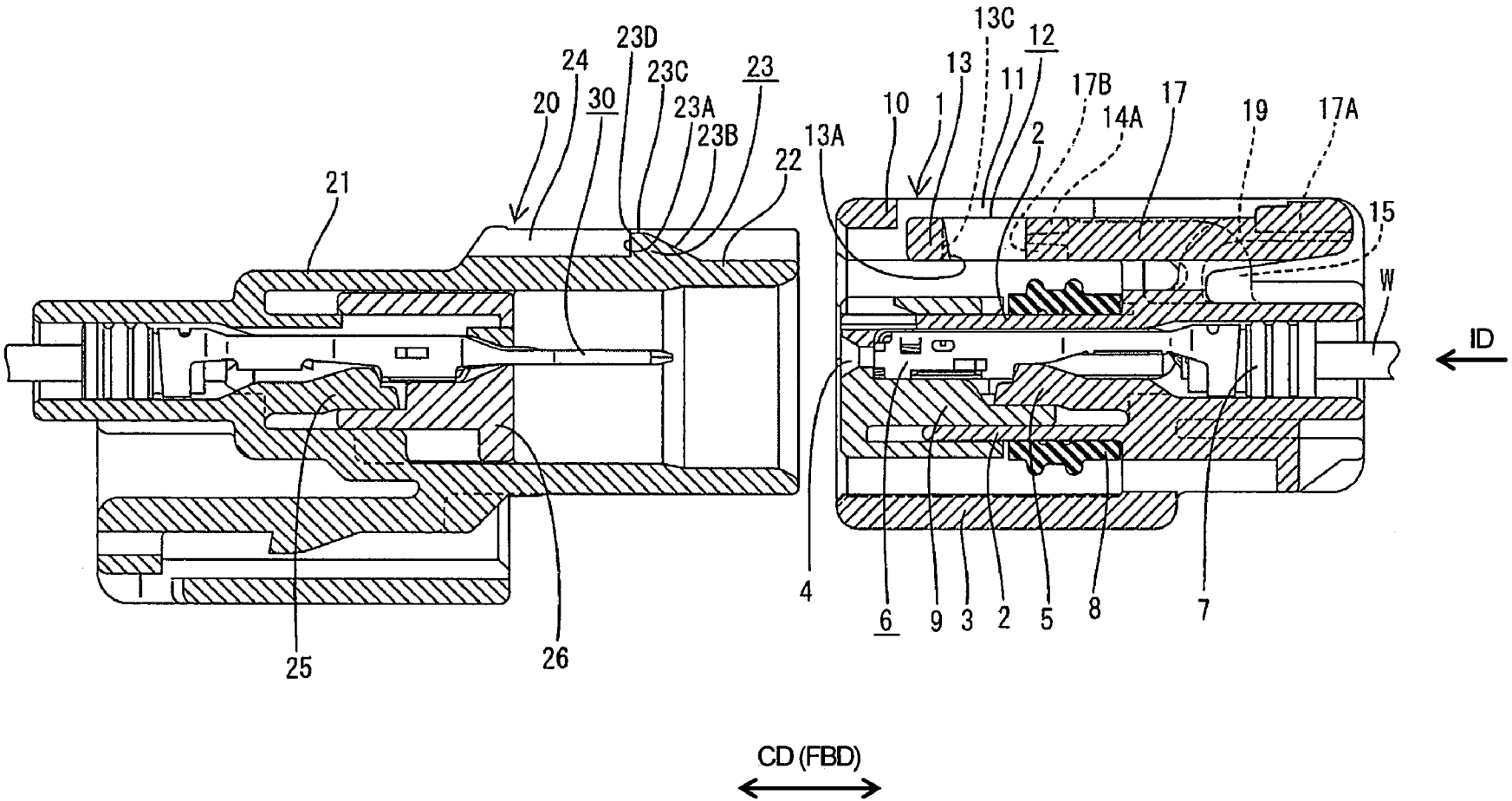
FIG. 1 is a longitudinal section showing a state before male and female connector housings are connected.
Figure 2:
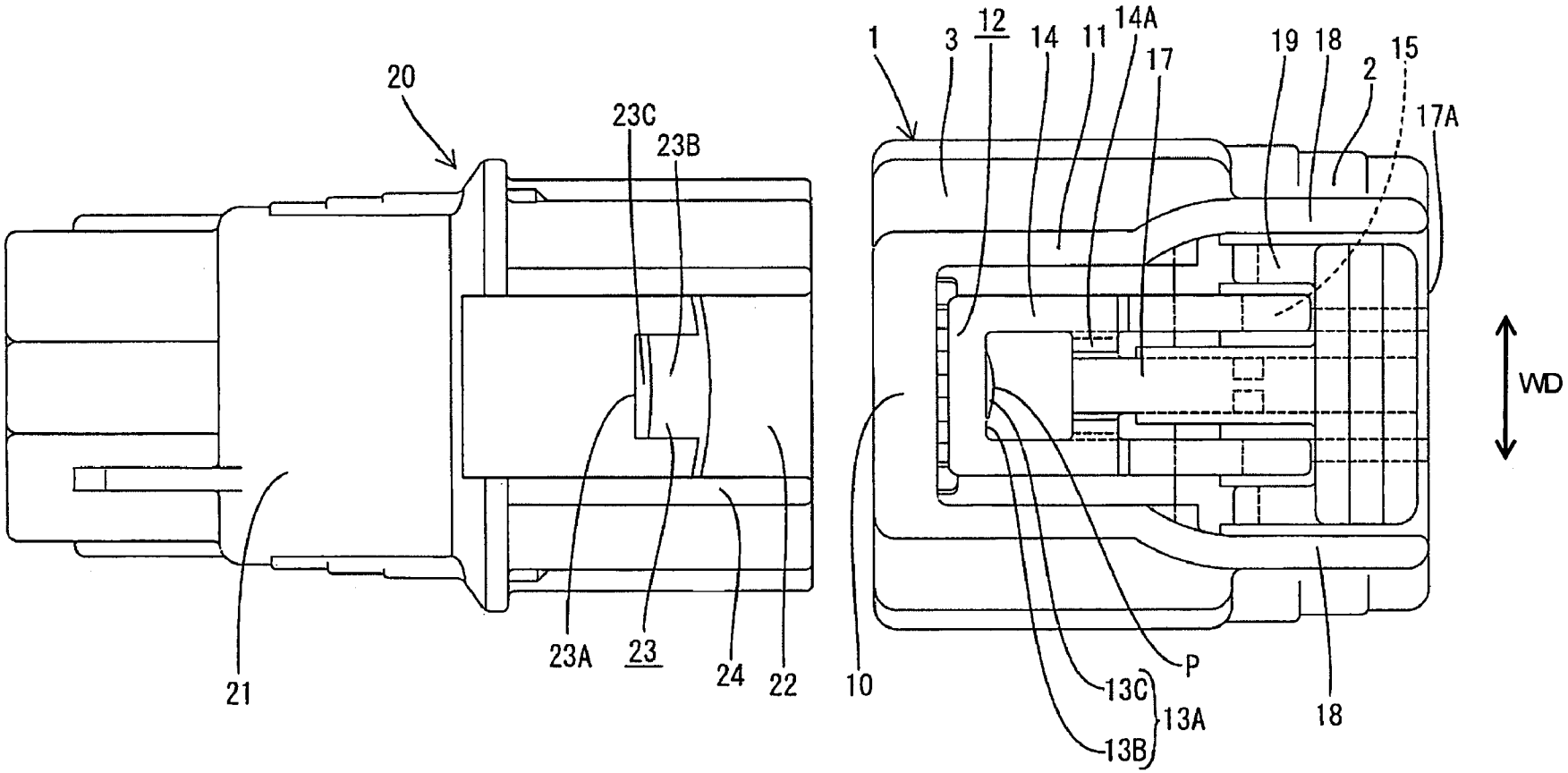
FIG. 2 is a plan view showing the state of FIG. 1.
Figure 3:
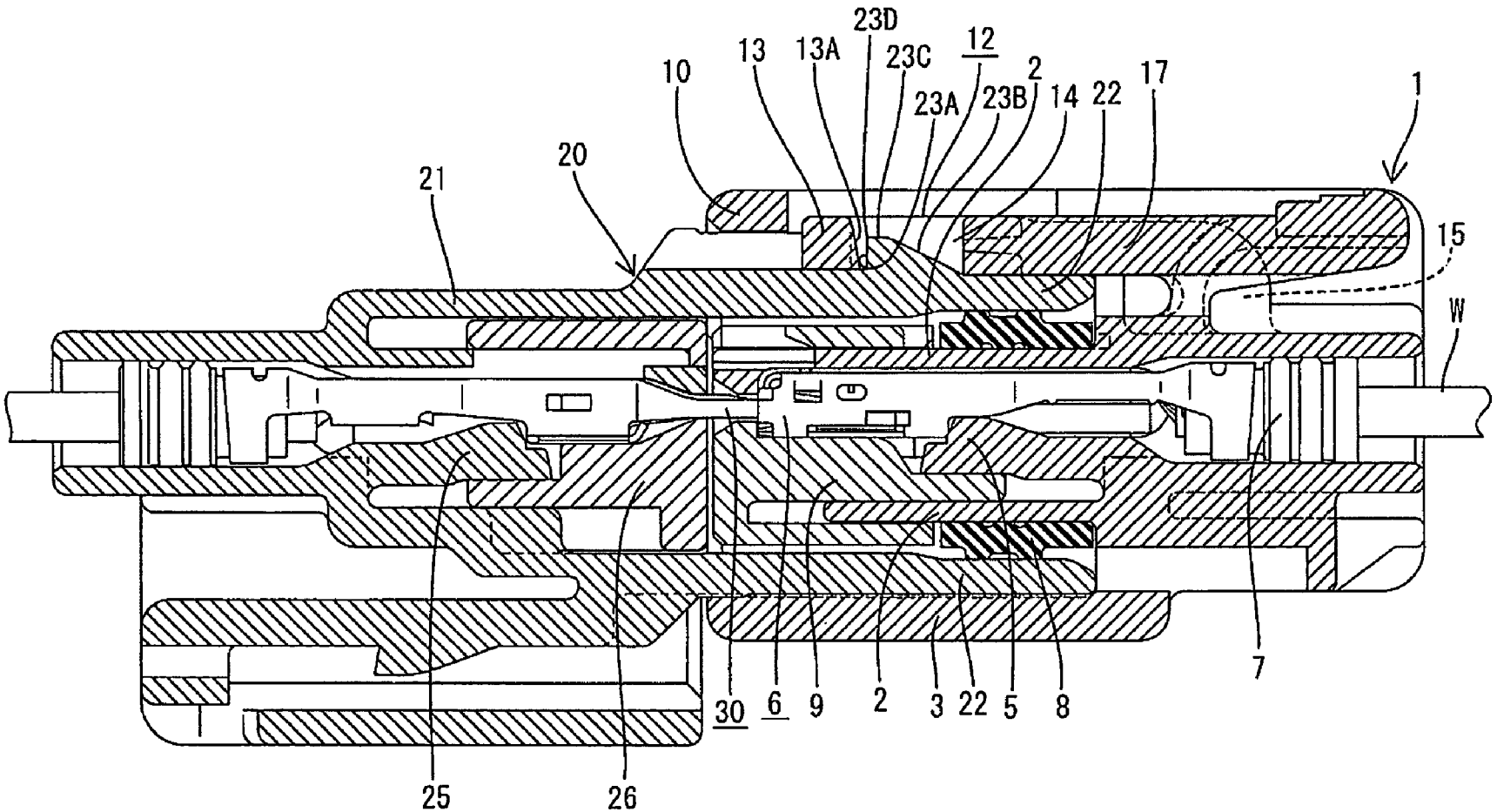
FIG. 3 is a longitudinal section showing a state attained by completing the connection of the male and female connector housings.
Figure 4:
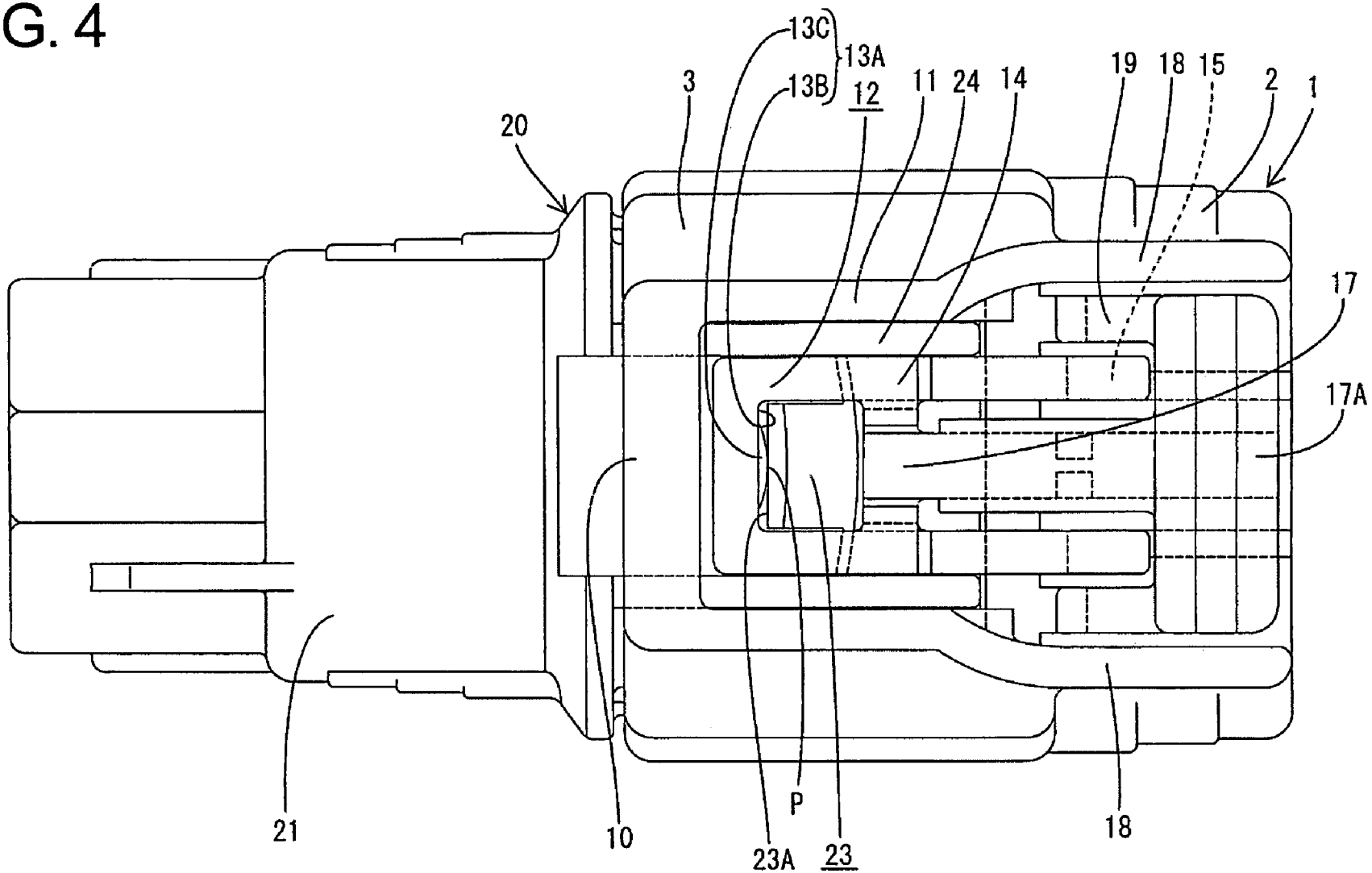
FIG. 4 is a plan view showing the state of FIG. 3.
Figure 5:
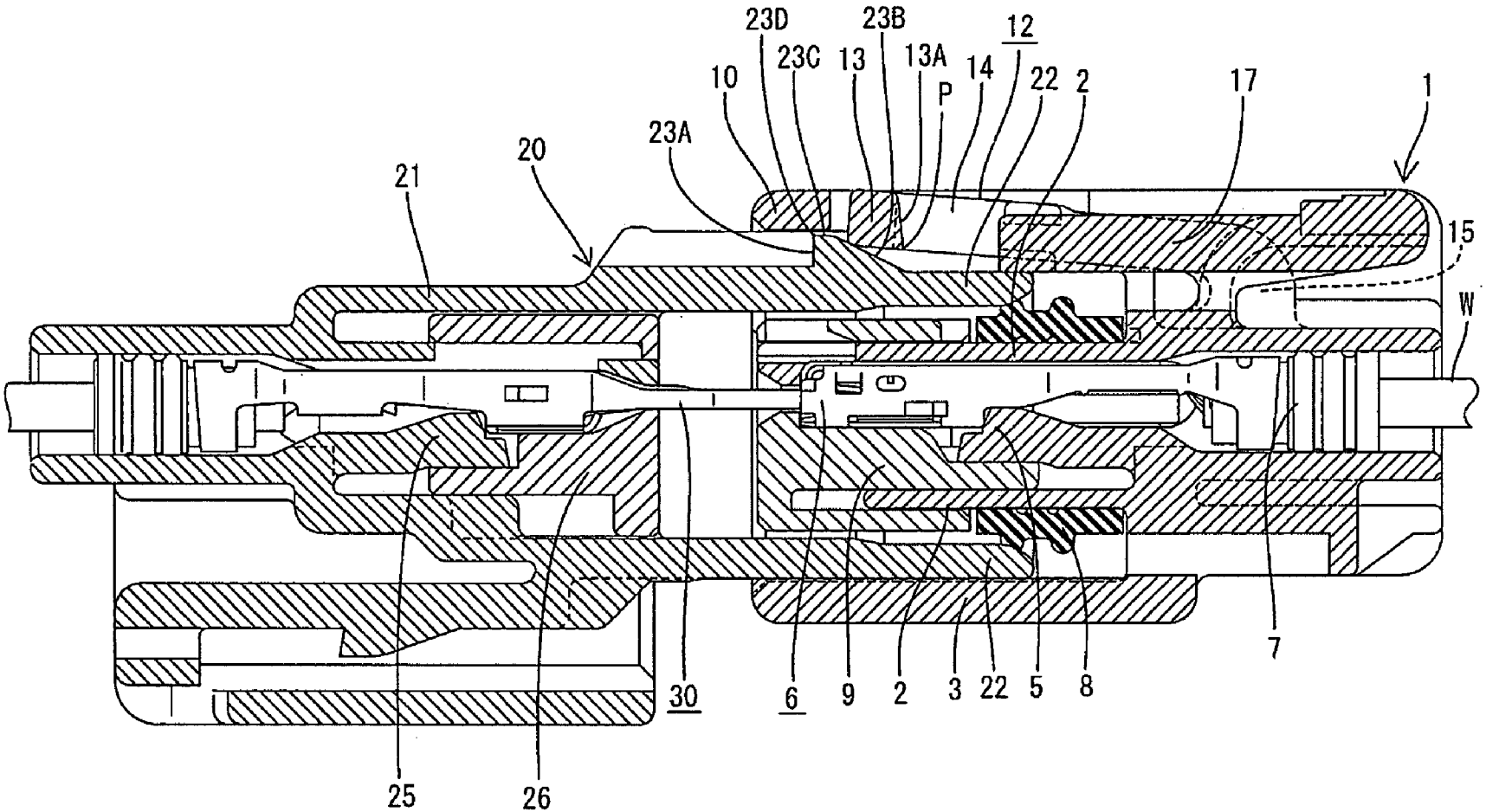
FIG. 5 is a longitudinal section showing an intermediate state of a connecting operation of the male and female connector housings.

A connector assembly according to the invention is illustrated in FIGS. 1 to 6. The connector assembly has male and female connectors that are connectable with each other substantially along a connecting direction CD. In the following description, reference is made to FIG. 1 concerning the vertical direction. The vertical direction in FIG. 2 is referred to as the width direction WD, the transverse direction in FIG. 1 is referred to as forward and backward directions FBD, and ends to be connected are referred to as the front.

The male connector includes a male housing 20 made e.g. of a synthetic resin, and male terminals 30 are inserted into the male housing 20 from behind. The male housing 20 has a wide block-shaped main portion 21 and a receptacle 22 projects unitarily from the front surface of the main portion 21. The male housing 20 has locks 25 that lock the male terminals 30 in positions so that tabs of the male terminals 30 project from the back surface of the receptacle 22. A retainer 26 is thrust under the leading end of the locks 25 to retain the male terminals 30. The retainer 26 also serves as a front-stop for the male terminals 30.

The female connector has a female housing 1 made e.g. of a synthetic resin. The female housing 1 has a wide block-shaped terminal accommodating portion 2 and a tubular portion 3 at least partly covers the terminal accommodating portion 2. The receptacle 22 can fit between the tubular portion 3 and the terminal accommodating portion 2. Cavities 4 extend in substantially forward and backward directions in the terminal accommodating portion 2, and female terminals 6 are insertable into the cavities 4 from behind and along an inserting direction ID. A lock 5 is formed at the bottom surface of each cavity 4.

Each female terminal 6 is crimped, bent or folded into connection with a wire W and with a waterproof rubber plug 7 at an end of the wire W. Additionally, each female terminal 6 is configured to be connected with the male terminal 30. The female terminals 6 can be inserted into the cavities 4 from behind. As a result, the female terminal 6 contacts the lock 5 and deforms the lock 5 out in a direction intersecting the inserting direction ID. The lock 5 is restored resiliently to lock the female terminal 6 when the female terminal 6 reaches a proper position. A retainer 9 is mountable from the front of the terminal accommodating portion 2 to prevent outward deformation of the locks for doubly locking the female terminals 6. The retainer 9 also retains a seal ring 8 fit at or near the base side of the terminal accommodating portion 2 to provide sealing between the two housings 1, 20.

An engaging portion 23 is formed on the upper surface of the receptacle 22 of the male housing 20 in a substantially middle position with respect to forward and backward directions FBD and a width direction WD that is substantially normal to the forward and backward directions FBD. A slanted or rounded guiding surface 23B is formed at the front of the engaging portion 23, and an upright engaging surface 23A is formed at the rear of the engaging portion 23. The engaging surface 23A is substantially normal to the connecting direction CD. Protection walls 24 are formed on the upper surface of the receptacle 22 and extend in substantially forward and backward directions FBD at opposite widthwise sides of the engaging portion 23.

An arch 10 bulges out at the front side of the upper surface of the tubular portion 3 and is hollow in forward and backward directions FBD. Guiding walls 11 are formed on the substantially opposite side surfaces of the arch 10. The guiding walls 11 guide connecting movements of the two housings 1, 20 by the sliding contact of the outer surfaces of the protection walls 24 and the inner surfaces of the guiding walls 11. As shown in FIG. 2, preventing walls 18 bulge out from the rear sides of the guiding walls 11 and then extend straight back.

A lock arm 12 is formed in an area of the upper surface of the female housing 1 at least partly surrounded by the arch 10 and the preventing walls 18. The lock arm 12 extends substantially in forward and backward directions FBD and substantially parallel to the connecting direction CD. A lock 13 is formed at the front end of the lock arm 12 and two substantially parallel arms 14 extend back from the lock 14. The arms 14 are spaced apart by a distance slightly greater than the width of the engaging portion 23 of the male housing 20. Bases 15 extend unitarily between rear ends of the arms 14 and a part of the upper surface of the female housing 1 behind the tubular portion 3. The lock arm 12 cantilevers forward from the bases and can undergo a resilient pivoting movement with the bases 15 as supports. Thus, front portions of the lock arm 12, including the lock 13, can deflect resiliently up and down in a direction intersecting the connecting direction CD.

An unlocking lever 17 is provided separately from the lock arm 12, as shown in FIG. 2, and is configured for unlocking the lock arm 12. The unlocking lever 17 extends substantially in forward and backward directions FBD between the arms 14 of the lock arm 12. Auxiliary levers 19 are provided at the opposite widthwise sides of the unlocking lever 17 and between the preventing walls 18. The auxiliary levers 19 extend substantially parallel with the unlocking lever 17, and rear ends of the auxiliary levers 19 and the unlocking lever 17 are connected by an operable portion 17A. Intermediate parts of the unlocking lever 17 and the auxiliary levers 19 are coupled to the upper surface of the terminal accommodating portion 2 on substantially the same line. Thus, a pressing force on the operable portion 17A will cause the unlocking lever 17 and the auxiliary levers 19 to make inclining movements together with the respective coupled positions as fulcrums.

Unlocking pieces 17B are formed at the front end of the unlocking lever 17 and project laterally out from the lower third of the unlocking lever 17. On the other hand, an unlock interacting piece 14A projects laterally in from the upper third of each arm 14. The lower surfaces of the unlock interacting piece 14A oppose the upper surfaces of the corresponding unlocking piece 17B with a small clearance therebetween. The lock arm 12 deforms resiliently during connection of the two housings 1, 20 and engages the engaging portion 23 without inclining the unlocking lever 17. However, the operable portion 17A can be pressed to incline the unlocking lever 17. Accordingly, the unlocking pieces 17B contact the unlock interacting pieces 14A and the lock arm 12 inclines in unlocking direction together with the unlocking lever 17 so that the two housings 1, 20 can be separated.

Figure 6:
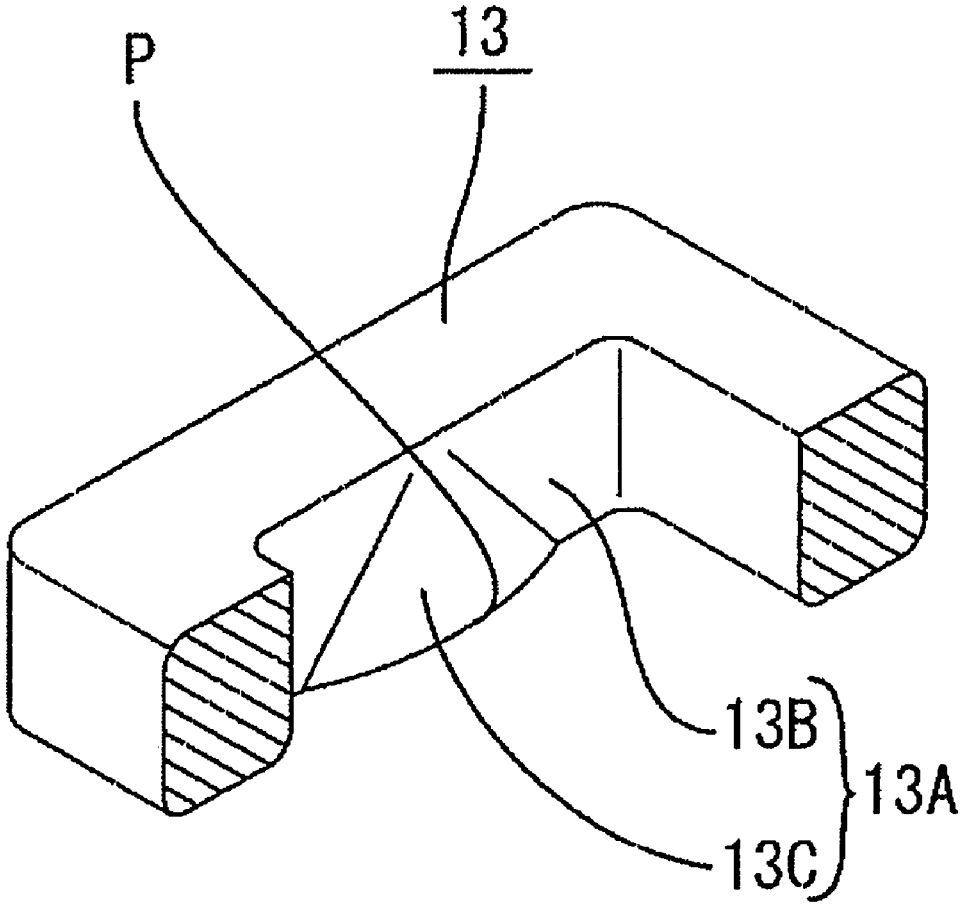
FIG. 6 is a perspective view partly in section showing a lock portion.

The lock 13 bridges the leading ends of the arms 14, and a locking surface 13A is defined at the rear of the lock 13. As shown in FIG. 6, the locking surface 13A has a vertical area 13B extending substantially normal to the connecting direction CD and a resistance alleviating portion 13C for alleviating resistance to the rear end of the upper surface of the engaging portion 23. The resistance alleviating portion 13C is substantially a section of a cone and has an apex substantially in the middle of the upper edge of the locking surface 13A. The bottom of the resistance alleviating portion 13C is close to the bottom edge of the locking surface 13A and bulges out horizontally to define a separating point P substantially at the widthwise center of the bottom edge of the locking surface 13A. The bulging amount of the resistance alleviating portion 13C is reduced gradually and symmetrically from the separating point P toward the opposite sides. Accordingly, the lock 13 can move onto the engaging portion 23 immediately before the two housings 1, 20 are connected properly. Additionally, the upper surface of the engaging portion 23 contacts the lock 13 only at the separating point P in a moment when the lock 13 passes the upper surface of the engaging portion 23.

The connector is assembled by mounting the seal ring 8 on the outer surface of the terminal accommodating portion 2. The female terminals 6 then are inserted into the respective cavities 4 of the female housing 1 from behind and along the inserting direction ID. Each female terminal 6 deforms the respective lock 5 during the insertion. However, the lock 5 restores resiliently when the female terminal 6 reaches the proper position to lock the female terminal 6. The retainer 9 then is fit from the front of the terminal accommodating portion 2 and into the space adjacent the locks 5 to prevent downward movement of the locks 5 and to lock the female terminals 6 redundantly. The retainer 9 also holds the seal ring 8 in position on the outer surface of the terminal accommodating portion 2. Similar operations are performed to assemble the male terminals 30 into the male housing 20.

The receptacle 22 of the male housing 20 then is fit in the connecting direction CD between the terminal accommodating portion 2 and the tubular portion 3 of the female housing 1. In this fitting process, the front-bottom of the lock 13 contacts the guiding surface 23B. The lock arm 12 inclines independently of the unlocking lever 17 and in a direction intersecting the connecting direction CD as the connecting operation progresses. Thus, the lock 13 slides on and along the guiding surface 23B and then moves onto the upper surface 23C of the engaging portion 23. The locking surface 13A is oblique to the vertical surface and to the connecting direction CD. As a result, the separating point P advances while being held substantially in point contact with the upper surface 23C. The locking surface 13A contacts the rear edge 23D of the engaging portion 23 only at the separating point P, and therefore can part more smoothly the rear edge 23D of the engaging portion 23 because of smaller resistance as compared to the line contact as in the prior art. The lock 13 then is freed from the contact state with the engaging portion 23 and restores resiliently to follow a pivoting path towards the front-lower side of the rear edge 23D. Thus, the locking surface 13A and the engaging surface 23A engage to lock the two housings 1, 20 in the connected state.

The operable portion 17C of the unlocking lever 17 is pressed down towards the housing 1 to separate the two housings 1, 20. Thus, the unlocking pieces 17B contact the unlock interacting pieces 14A, and the lock 13 at the leading end of the lock arm 12 is lifted outwardly as the leading end of the unlocking lever 17 moves away from the housing 1. The resistance alleviating portion 13C of the lock 13 contacts the rear edge 23D of the engaging portion 23 as the two housings 1, 20 are pulled apart from each other. At this time, the resistance alleviating portion 13C and the rear edge 23D are substantially in point contact. Hence, the two housings 1, 20 can be pulled part without any dragging feeling and the contact resistance is held down.

As described above, the lock 13 and the engaging portion 23 are substantially in point contact with each other due to the resistance alleviating portion 13C on the locking surface 13A. By alleviating the contact resistance, it becomes possible to improve connection feeling and separation feeling.

The invention is not limited to the above described and illustrated embodiment. For example, the following embodiments also are embraced by the technical scope of the present invention as defined by the claims. Beside the following embodiments, various changes can be made without departing from the scope and spirit of the present invention as defined by the claims.

Although the resistance alleviating portion assumes the shape of a section of a cone in the foregoing embodiment, it may assume another shape provided that the lock and the engaging portion can be held substantially in point contact. For example, the resistance alleviating portion may assume the shape of a triangular or polygonal pyramid or have a substantially elliptic or pointed protruding shape.

Although the lock is formed with the resistance alleviating portion in the first embodiment, the engaging portion may be formed therewith provided that the lock and the engaging portion can be held substantially in point contact.

Although the lock arm is cantilevered in the foregoing embodiment, it may be supported at both ends or have a substantially bridge-like shape. The lock arm may assume any shape provided that the lock and the engaging portion can be held substantially in point contact at their touching portions immediately before the lock arm starts being resiliently deformed.

What is claimed is:

1. A connector, comprising:

a first housing (1);

a second housing (20) connectable with the first housing (1) and formed with an engaging portion (23);

a resiliently deformable lock arm (12) provided on the first housing (1) and including a lock (13), the lock arm (12) being resiliently deformed at least at an intermediate stage of a connecting operation of the housings (1, 20), the lock (13) contacting an edge (23D) of the engaging portion (23) immediately before a proper connection of the housings (1, 20), and the lock arm (12) restoring resiliently to engage the lock (13) and the engaging portion (23) and to lock the housings (1, 20) in a properly locked state; and a resistance alleviating portion (13C) on at least one of the lock (13) and an edge (23D) of the engaging portion (23) that rub against each other immediately before the proper connection of the housings (1, 20), the resistance alleviating portion (13C) having an apex locally projecting towards a mating rubbed part (23D).

2. The connector of claim 1, wherein the lock (13) is provided at a leading end of the lock arm (12).

3. The connector of claim 1, wherein the lock (13) parts from the edge (23D) by canceling a rubbed state against the edge (23D) after the proper connection of the housings (1, 20), and the lock arm (12) restores resiliently.

4. The connector of claim 1, wherein the lock arm (12) is cantilevered forwardly and the lock (13) is substantially at a leading end thereof, the engaging portion (23) projecting from an outer surface of the second housing (20).

5. The connector of claim 1, wherein the lock (13) moves onto the engaging portion (23) and contacts the edge (23D) of the engaging portion (23) at an intermediate stage of the connecting operation of the two housings (1, 20) and, then, parts from the edge (23D) of the engaging portion (23) by canceling the rubbed state against the edge (23D), whereupon the lock arm (12) restores resiliently so that the lock (13) engages the engaging portion (23).

6. The connector of claim 1, wherein the resistance alleviating portion (23D) is a cone or pyramid having an apex oriented substantially towards a part of the lock (13) to be rubbed against the rear edge (23D) of the engaging portion (23).

7. The connector of claim 6, wherein the resistance alleviating portion (13C) of the lock (13) comes substantially into point contact with the edge (23D) of the engaging portion (23).

8. The connector of claim 1, further comprising an unlocking lever (17) separate from the lock arm (12) and being substantially undeformed during connection the two housings (1, 20), an operable portion (17A) being formed on the unlocking lever (17) and being operable to incline the unlocking lever (17) and the lock arm (12) for separating the two housings (1, 20).

9. The connector of claim 1, further comprising at least one protection wall (24) at a widthwise side of the engaging portion (23) and extending substantially in forward and backward directions (FBD).

10. The connector of claim 9, further comprising at least one guiding wall (11) for sliding in contact with the protection wall (24) to guide connection of the two housings (1, 20).

11. A connector, comprising:

a first housing (1);

a second housing (20) connectable with the first housing (1);

an engaging portion (23) projecting from a surface of the second housing (20); and a resiliently deformable lock arm (12) on the first housing (1) and a lock (13) formed on the lock arm (12), the lock (13) being disposed to contact the engaging portion (23) at an intermediate stage of connecting the housings (1, 20) for resiliently deforming the lock arm (12) as the housings (1, 20) are being connected, the lock arm (12) being configured to restore resiliently so that the lock (13) engages the engaging portion (23) to lock the housings (1, 20) in a proper connection, a resistance alleviating portion (13C) being formed on the lock (13) and configured to move in substantially point contact with an opposed edge (23D) of the engaging portion (23) immediately before the proper connection of the housings (1, 20).

12. The connector of claim 11, wherein the resistance alleviating portion (13C) has an apex locally projecting towards the edge (23D) of the engaging portion (23).

13. The connector of claim 11, wherein the lock arm (12) is cantilevered forwardly and the lock (13) is substantially at a leading end thereof.

14. The connector of claim 11, wherein the resistance alleviating portion (13C) is a cone or pyramid having an apex oriented substantially towards the edge (23D) of the engaging portion (23).

15. The connector of claim 11, further comprising an unlocking lever (17) separate from the lock arm (12) and being substantially undeformed during connection the two housings (1, 20), an operable portion (17A) being formed on the unlocking lever (17) and being operable to incline the unlocking lever (17) and the lock arm (12) for separating the two housings (1, 20).

* * * * *